US006216515B1

(12) United States Patent
Grimmel et al.

(10) Patent No.: US 6,216,515 B1
(45) Date of Patent: Apr. 17, 2001

(54) ROLL STAND ARRANGEMENT FOR A SINGLE WIRE ROLLING MILL TRAIN

(75) Inventors: Rüdiger Grimmel, Netphen; Michael Kruse, Düsseldorf, both of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/533,474

(22) Filed: Mar. 23, 2000

(30) Foreign Application Priority Data

Mar. 25, 1999 (DE) ..... 199 13 452

(51) Int. Cl.[7] ..... B21B 41/04; B21B 41/02
(52) U.S. Cl. ..... 72/228; 72/231
(58) Field of Search ..... 72/228, 231, 201

(56) References Cited

U.S. PATENT DOCUMENTS 3,228,505 * 1/1966 Leitner ..... 72/228
3,774,433 * 11/1973 Pauels ..... 72/203
5,307,663 * 5/1994 Shore et al. ..... 72/228
5,345,805 * 9/1994 Hauck ..... 72/201
5,893,288 * 4/1999 Shore ..... 72/228
5,943,753 * 8/1999 Buchsbaum et al. ..... 29/33

* cited by examiner

*Primary Examiner*—Rodney A. Butler
(74) *Attorney, Agent, or Firm*—Brown & Wood, LLP

(57) ABSTRACT

A roll stand arrangement for a single wire rolling mill train, and including arranged along a main pitch line, a multi-stand finishing block, a multi-stand post finishing block located downstream of the finishing block, and a pitch line change-over unit arranged between the finishing block and the post finishing block for advancing a wire strand from the finishing block to the post finishing block directly or through a looping pitch line in which there are provided a cooling zone, a wire looper, and a looping table.

1 Claim, 1 Drawing Sheet

ROLL STAND ARRANGEMENT FOR A SINGLE WIRE ROLLING MILL TRAIN

BACKGROUND OF THE INVENTION

1. Field of the Invention

The present invention relates to a roll stand arrangement for a single wire rolling mill train and including a multi-stand finishing block, and a multi-stand post finishing block with, alternatively, non-cooling or cooling of a wire strand between the finishing block and the post finishing block.

2. Description of the Prior Art

An arrangement of this type is disclosed in a European Patent Publication EP 512 735 B1. The arrangement disclosed in EP 512 735 B1 permits to obtain a flexible calibration of working rolls in order to meet different production requirements and, thereby, provides for a better use of the rolling mill train. The post finishing block in EP 512 735 B1 includes at least two but, primarily, four roll mill stands. A further advantage of the arrangement, which is disclosed in the above-mentioned European Publication, consists in that better tolerances can be obtained by rolling the wire strand in the last stands of the post finishing block with a reduced pass reduction. However, with the arrangement disclosed in the European application, different cooling requirements cannot be met which, e.g., should be met when thermomechanical rolls are used. The meeting of the cooling requirements necessitates a provision of a more or less long cooling zone between the finishing block and the post finishing block. However, with existing arrangements in which the finishing block and the post finishing block are spaced from each other by a short distance, such cooling zones cannot be provided.

However, roll stand arrangements with finishing and post finishing blocks, in which cooling of the wire strand is possible, are known. Thus, German Patent DE-AS 42 17 149 discloses a roll stand arrangement in which there are provided, between a group of intermediate roll stands and the finishing block, two 180°-wire loopers displaceable relative to each other in the rolling direction and in the direction opposite the rolling direction, and one or more cooling installations arranged between the two loopers.

A German Patent application DE 198 43 032 discloses a roll stand arrangement in which a finishing block and a post finishing block provided in a first pitch line are located close to each other, and a second finishing block is provided in a second pitch line. The second pitch line branches from the first pitch line at a point behind an intermediate rolling mill train and extends parallel to the first pitch line. Two 180°-loopers are provided between the finishing block and the post finishing block, with one or more cooling installation being provided between the two loopers.

Another German Publication DE-198 33 505 discloses a roll stand arrangement in which two parallel pitch lines branch from a point behind the intermediate rolling mill train and are combined before a wire treating installation. A finishing block and post finishing block are arranged in one of the branch pitch lines, and in another of the branch pitch lines, there are provided a post finishing block and one or more cooling installations located behind the post finishing block.

An object of the present invention is to provide a roll stand arrangement including a finishing block and a post finishing block located close to each other and which can be used for rolling steel wires which, after rolling in a finishing block, in order to obtain a controllable temperature profile, are subjected to cooling before finally being rolled in the post finishing block.

SUMMARY OF THE INVENTION

This and other objects of the present invention, which will become apparent hereinafter, are achieved by providing between the finishing and post finishing blocks, a pitch line change-over unit that advances the wire strand directly from the finishing block to the post finishing block or advances the wire strand from the finishing block to the post finishing block through a looping pitch line in which there are provided a cooling zone, a wire looper, and a looping table.

According to a preferred embodiment of the present invention, the pitch line change-over unit includes a linear wire guide, which extends parallel to the main pitch line, and two, crossing each other, branch wire guides. The arrangement has means for alternatively displacing the pitch line change-over unit between a first position in which inlet and outlet openings of the linear wire guide are located in the main pitch line, and a second position in which an inlet opening of one of the branch wire guides and an outlet opening of another of the branch wire guides are located in the main pitch line, and an outlet opening of the one of the branch wire guides is connected with an entrance of the looping pitch line and an inlet opening of the another of the branch wire guide is connected with an exit of the looping pitch line.

The provision, according to the present invention, of a pitch line changeover unit between finishing and post finishing blocks permits, with small technical expenditures and with a relatively small space requirement, to use the roll stand arrangements with finishing and post finishing blocks also for rolling of a steel wire, the rolling of which and, in particular, the temperature control requires use of more or less long cooling zones. The transition from rolling without wire cooling to rolling with cooling of the rolled wire is effected simply by displacement the pitch line change-over unit from one position to another position.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
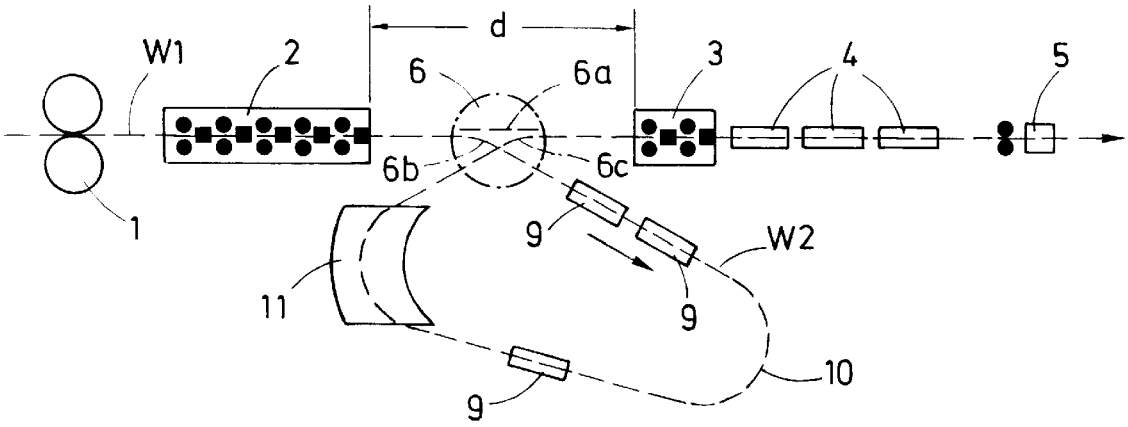
FIG. 1. a schematic plan view of a roll stand arrangement according to the present invention.
Figure 2:
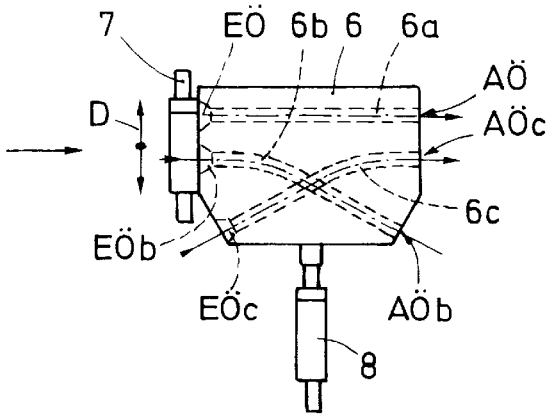
FIG. 2. a schematic plan view of a detail of the roll stand arrangement show in FIG. 1.
Figure 3:
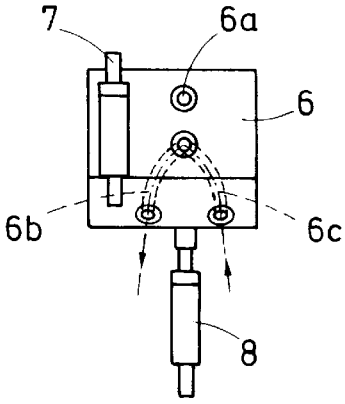
FIG. 3. a side view of the detail shown in FIG. 2.

As can be seen in FIG. 1, along a pitch line W1, a finishing block 2 is located behind a last rolling mill stand 1 of an intermediate roll train (not shown), and a post finishing block 3 is provided behind, downstream, of the finishing block 2 at a short distance from the finishing block 2 along the same pitch line W1, a cooling zone 4 is provided downstream of the post finishing block 3, with a wire reel 5 being arranged downstream of the cooling zone 4. A pitch line change-over unit 6 is located between the finishing block 2 and the post finishing block 3 (see also FIGS. 2 and 3) and includes a linear wire guide 6*a* and two, crossing each other, branch wire guides 6*b* and 6*c*. The pitch line change-over unit 6, which is displaceable along a guide 7, is alternatively displaced between two positions, in a direction of a double arrow D, by a pusher 8. In one of the two positions, the inlet and outlet openings of the wire guide 6*a* are located in the pitch line W1. In the other of the two positions, the inlet opening EÖb of the branch wire guide 6*b* and the outlet opening AÖc of the other branch wire guide 6*c* are located in the pitch line W1. The outlet opening AÖb of the branch wire guide 6*b* leads, as shown in FIG. 1, to a second pitch line, the looping pitch line W2, in which a second cooling zone 9 is provided. The looping pitch line W2 is brought back into the pitch line W1 through the inlet opening EÖc of the branch wire guide 6*c* and the outlet opening AÖc of the branch wire guide 6*c* with a wire looper 10 and a looping table 11.

As can be seen, the pitch line change-over unit 6 permits to advance a wire strand, which comes out of the intermediate roll train, through the finishing block 2 and the post finishing block 3 without any intermediate treatment or with an intermediate treatment of the wire strand after it leaves the finishing block 2 in the cooling zone 9, with length compensation by the looping table 11. This permits to keep the short distance d between the finishing block 2 and the post finishing block 3 unchanged.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A roll stand arrangement for a single wire rolling mill train, comprising arranged along a main pitch line, a multi-stand finishing block; a multi-stand post finishing block located downstream of the finishing block; and a pitch line change-over unit arranged between the finishing block and the post finishing block for advancing a wire strand from the finishing block to the post finishing block one of directly and through a looping pitch line in which there are provided a cooling zone, a wire looper, and a looping table, wherein the pitch line change-over unit comprises a linear wire guide extending parallel to the main pitch line, and two, crossing each other, branch wire guides, and wherein the arrangement further comprises means for alternatively displacing the pitch line change-over unit between a first position in which inlet and outlet openings of the linear wire guide are located in the main pitch line, and a second position in which an inlet opening of one of the branch wire guides and an outlet opening of another of the branch wire guides are located in the main pitch line, and an outlet opening of the one of the branch wire guides is connected with an entrance of the looping pitch line and an inlet opening of the another of the branch wire guide is connected with an exit of the looping pitch line.

* * * * *